US009399893B2

(12) United States Patent
Viellard et al.

(10) Patent No.: US 9,399,893 B2
(45) Date of Patent: Jul. 26, 2016

(54) STOPPERS FOR STRUCTURES ATTACHED TO HYBRID RISER TOWERS

(71) Applicant: Acergy France SAS, Suresnes (FR)

(72) Inventors: Brice Viellard, Boulogne-Billancourt (FR); Blaise Seguin, Paris (FR); Emilie Brunet, Paris (FR)

(73) Assignee: Acergy France SAS, Suresnes (FR)

( * ) Notice: Subject to any disclaimer, the term of this patent is extended or adjusted under 35 U.S.C. 154(b) by 0 days.

(21) Appl. No.: 14/375,406

(22) PCT Filed: Jan. 30, 2013

(86) PCT No.: PCT/IB2013/000533

§ 371 (c)(1),
(2) Date: Jul. 29, 2014

(87) PCT Pub. No.: WO2013/114211

PCT Pub. Date: Aug. 8, 2013

(65) Prior Publication Data

US 2015/0007999 A1 Jan. 8, 2015

(30) Foreign Application Priority Data

Jan. 30, 2012 (GB) ..... 1201560.8

(51) Int. Cl.
*E21B 17/10* (2006.01)
*E21B 17/01* (2006.01)

(52) U.S. Cl.
CPC ..... *E21B 17/012* (2013.01); *E21B 17/1035* (2013.01)

(58) Field of Classification Search
USPC ..... 166/345, 350, 367
See application file for complete search history.

(56) References Cited

U.S. PATENT DOCUMENTS

| | | | | | |
|---|---|---|---|---|---|
| 3,729,756 | A * | 5/1973 | Cook et al. | ..... | 441/133 |
| 4,474,129 | A * | 10/1984 | Watkins et al. | ..... | 114/243 |
| 4,477,207 | A * | 10/1984 | Johnson | ..... | 405/195.1 |
| 2002/0134553 | A1 * | 9/2002 | Woodrow | ..... | 166/367 |
| 2004/0086339 | A1 * | 5/2004 | Tyrer et al. | ..... | 405/156 |
| 2011/0240308 | A1 * | 10/2011 | Legras | ..... | 166/367 |

FOREIGN PATENT DOCUMENTS

| | | | | | |
|---|---|---|---|---|---|
| GB | 2104940 | B * | 4/1985 | ..... | E21B 17/01 |
| WO | WO 98/53176 | | 11/1998 | | |
| WO | WO 01/14687 | | 3/2001 | | |
| WO | WO 02/16726 | | 2/2002 | | |
| WO | WO 02/053869 | | 7/2002 | | |
| WO | WO 2005/019595 | | 3/2005 | | |
| WO | WO 2005019595 | A1 * | 3/2005 | ..... | E21B 17/01 |
| WO | WO 2008/001087 | | 1/2008 | | |
| WO | WO 2010/035248 | | 4/2010 | | |
| WO | WO 2010/107322 | | 9/2010 | | |

* cited by examiner

*Primary Examiner* — James G Sayre
(74) *Attorney, Agent, or Firm* — Levy & Grandinetti

(57) ABSTRACT

A coated or sleeved pipe for a hybrid riser tower is disclosed. The pipe has at least one stop formation that is integral with or attached to an external coating or sleeve of the pipe. The stop formation is arranged to restrain movement along the pipe of a structure attached to the pipe, such as a guide frame.

23 Claims, 4 Drawing Sheets

STOPPERS FOR STRUCTURES ATTACHED TO HYBRID RISER TOWERS

This Application is the U.S. National Phase of International Application Number PCT/IB2013/000533 filed on Jan. 30, 2013, which claims priority to Great Britain Patent Application No. 1201560.8 filed on Jan. 30, 2012.

This invention relates to subsea risers used in the oil and gas industry to transport well fluids from the seabed to a surface installation such as an FPSO vessel or a platform. The invention relates particularly to hybrid riser towers and more particularly to stoppers for guide frames or other structures attached to hybrid riser towers.

Hybrid riser systems have been known for many years in the development of deepwater and ultra-deepwater fields. They comprise a subsea riser support extending from a seabed anchor to an upper end held buoyantly in mid-water, at a depth below the influence of likely wave action. A depth of 70 m to 250 m is typical for this purpose but this may vary according to the sea conditions expected at a particular location.

An example of a hybrid riser system is a hybrid riser tower or 'HRT', used for instance in the Girassol and Greater Plutonio field developments lying in approximately 1200 m to 1500 m of water off Angola. An HRT is pivotably attached to its anchor and is held in tension by a buoyancy tank at its upper end. Riser pipes extend upwardly from the seabed to the upper end region of the riser support, as an upright bundle of generally parallel pipes defining a riser column. The buoyancy of the buoyancy tank is typically supplemented by buoyancy modules distributed along the riser column.

Flexible jumper pipes hanging as catenaries extend from the upper end of the riser column to an FPSO or other surface installation. The jumper pipes add compliancy that decouples the more rigid riser pipes from surface movement induced by waves and tides. The riser pipes experience less stress and fatigue as a result.

Umbilicals and other pipes generally follow the paths of the riser pipes and jumper pipes to carry power, control data and other fluids. As a result, the bundle in the riser column may comprise some pipes used for oil production, some pipes used for injection of water and/or other fluids, some gas-lift lines and/or some other pipes used for oil and gas export. Those pipes are clustered around a central core that may be a hollow, solely structural tube or that may convey fluids in use.

In the Girassol development, for example, each riser tower is a bundle comprising one 22-inch (55.9 cm) structural core tube surrounded by four 8-inch (20.3 cm) production risers; four 3-inch (7.6 cm) gas lift lines; two 2-inch (5.1 cm) service lines; and two 8-inch (20.3 cm) injection risers for either water or gas injection.

For the Girassol development, insulating material in the form of syntactic foam blocks surrounds the central core tube and the pipes and separates conduits carrying hot and cold fluids. Syntactic foam blocks also serve as buoyancy modules that add buoyancy to the tower.

The main purpose of insulation in a subsea pipe is to retain heat in hydrocarbons or other hot fluids flowing in a flowline, by resisting heat transfer from those fluids to the much colder water surrounding the pipe. The insulation also allows the system to meet criteria for cooldown time, which assures flow and avoids re-start problems by resisting hydrate formation or wax deposition during shutdowns.

Most or all of the pipes in an HRT will typically be of steel, including a pipe defining the core tube. Polypropylene (PP) is commonly used to coat a steel pipe in subsea applications to mitigate corrosion and to prevent mechanical damage; the coating also insulates the pipe to some extent. For example, a three-layer PP (3LPP) coating may be used for, predominantly, corrosion protection and mechanical protection, and a five-layer PP (5LPP) coating may be used for additional thermal insulation. Additional layers are possible.

A 3LPP coating typically comprises an epoxy primer applied to the cleaned outer surface of the pipe. As the primer cures, a second thin layer of PP is applied so as to bond with the primer and then a third, thicker layer of extruded PP is applied over the second layer for mechanical protection. A 5LPP coating adds two further layers, namely a fourth layer of PP modified for thermal insulation e.g. glass syntactic PP (GSPP) or a foam, surrounded by a fifth layer of extruded PP for mechanical protection of the insulating fourth layer.

In some HRTs, the risers and other lines are guided and retained relative to the central core tube by foam elements that provide buoyancy and insulation. It is also known for HRTs to have a series of guide frames spaced along their length, to guide and retain the risers and other lines relative to the core tube. In some applications, the guide frames also transfer buoyancy loads from buoyancy modules to the core tube.

WO 02/053869 to Stolt and WO 2010/035248 to Acergy disclose some examples of guide frames for HRTs. Their content is incorporated herein by reference. WO 2010/035248, for example, teaches that a guide frame may be composed largely of a non-metallic material, for example a plastics material such as polyurethane (PU). However a guide frame may instead be composed largely of a metal such as steel or a combination of metals and plastics.

The guide frame disclosed in WO 2010/035248 is in two halves that clamp together around a central core tube to grip the core tube with frictional engagement. Similarly, buoyancy modules may be placed around the core tube and bolted or strapped together so that their buoyant load is also transmitted to the core tube by friction. It is also possible for buoyancy modules to be carried by a guide frame to impart their buoyant load to the guide frame and thus, indirectly, to the core tube to which the guide frame is attached.

In WO 2010/035248, radially-projecting stoppers are welded to the outside of the core tube to resist upward movement of the guide frame under buoyant load from the buoyancy modules. The stoppers may come into play if frictional engagement between the guide frame and the core tube is insufficient to resist upward slippage of the guide frame. For example, if bolts or straps between buoyancy modules that are frictionally engaged with the core tube should loosen, the buoyancy modules could slide up the core tube and bear against a guide frame mounted to the core tube above. A stopper mounted on the core tube above the guide frame will limit axial movement of the guide frame along the core tube in that event.

The core tube in WO 2010/035248 is solely a structural member that does not carry any fluids itself. This enables stoppers to be welded to it. However, there is a reluctance from some oil and gas operating companies to have stoppers welded to a pipe that serves as a flowline for hydrocarbon fluids. It is common practice in the oil and gas industry to use forged fittings (such as hanger flanges or J-lay collars) in order to limit the manufacturing process to girth welds. In addition, for hot hydrocarbon fluids susceptible to hydrate formation, effective insulation must be ensured consistently along all points in the flowline, which means that localised 'cold spots'—such as may be caused by the thermal bridging effect of structures such as connectors or stoppers attached to a pipe—have to be avoided. Consequently, the stopper solution of WO 2010/035248 cannot be used on flowlines in HRT bundles in which all the pipes carry fluids—in which case there is no solely structural core tube that does not carry fluids.

Like the alternatives of a welded collar or a forged piece, a welded stopper cannot be used on flowlines in HRT bundles for other reasons. For example, it may interrupt the continuity of coating on the pipe. Also, fillet welds on fluid-carrying pipelines are best avoided because they can locally jeopardise the properties of the steel from which the pipe is made. This would at least require specific welding and coating qualifications and intensive non-destructive testing during fabrication, which is time-consuming and costly.

In WO 2005/019595, a clamp formed of two half-shells is secured to a riser by a tension band. There is no reference to a coating, noting that attachment by clamping would jeopardise the integrity of a coating. Similarly, US 2002/134553 discloses a stop bracket that is clamped to a riser pipe surrounded by a rubber sleeve. Again, attachment by clamping would jeopardise the integrity of the sleeve.

WO 02/16726 discloses a coating that embeds buoyancy modules by being moulded around the modules. There is no possibility of a moulded-in buoyancy module moving longitudinally and therefore needing a stopper.

It is against this background that the present invention has been devised.

Broadly, the invention resides in an externally coated or sleeved pipe suitable for supporting guide frames or other structures in a hybrid riser tower, the pipe having at least one stop formation arranged to restrain movement along the pipe of a structure attached to the pipe, which formation is integral with the external coating or sleeve of the pipe or is part of a stop bracket, predominantly of plastics, that is welded or bonded to the external coating or sleeve. The pipe is substantially straight when part of a riser column of an HRT, particularly when under tension. The pipe of the invention may therefore be described as substantially straight, and/or tensioned and/or upright when in use.

Unlike in the HRT prior art, the core pipe may be a flowline for carrying fluids up or down the tower; indeed, such fluids may be in contact with an internal wall of the pipe. This is possible because the stop formation is insulated from the pipe by the external plastics coating of the pipe, and because there is no need to weld the stop formation directly to the pipe. The stop formation is preferably predominantly of plastics for insulation and for compatibility with the coating of the pipe, although additional non-plastics reinforcement is possible.

The stop formation preferably comprises a downwardly-facing shoulder to resist upthrust acting on a structure when attached to the pipe; it may also comprise an upwardly-facing shoulder to resist weight load acting on such a structure. Advantageously there is also a key formation having at least one circumferentially-facing side wall to resist rotation about the pipe of a structure attached to the pipe. Such a key formation is conveniently disposed between opposed axially-spaced stop formations.

In some variants, the stop formation may be machined from an external plastics coating or epoxy sleeve of the pipe. Other variants have a stop bracket welded or bonded to such a coating or sleeve of the pipe and comprising a stop formation that extends radially outwardly beyond a general outer diameter of the pipe.

A stop bracket is suitably welded or bonded to the external coating or sleeve of the pipe and optionally also to an exposed wall of the pipe. However the welding or bonding may be supplemented by a mechanical connection between the stop bracket and the coated or sleeved pipe.

A stop bracket may be attached to a continuous interface area of the external coating or sleeve of the pipe. In that case, the stop bracket suitably has a continuous interface surface arranged to lie against the coating or sleeve of the pipe, a longitudinal section through that interface surface being substantially straight. Alternatively, the external coating or sleeve of the pipe may be interrupted to expose a wall of the pipe at a field joint, for example. In that case, the stop bracket preferably spans the interruption and encloses the exposed wall of the pipe, being attached to coating portions on opposite sides of the interruption.

Where the pipe has an exposed wall region and the opposed coating or sleeve portions on each side comprise facing end surfaces, the stop bracket advantageously lies at least partially between those facing end surfaces. This improves bonding and mechanical location of the stop bracket in relation to the pipe. Indeed, a portion of the stop bracket lying between the facing end surfaces may be bonded to the exposed wall of the pipe. To achieve this, the stop bracket suitably has a stepped interface surface arranged to lie against the pipe and its coating or sleeve, the interface surface comprising end sections separated by a central section that is stepped toward the pipe. Step surfaces between the central section and the end sections may be frusto-conically inclined to complement a corresponding taper of the facing end surfaces.

From the foregoing, it will be clear that the inventive concept also embraces a stop bracket attachable by welding or bonding to an external coating or sleeve of a pipe for a hybrid riser tower, the bracket being predominantly of plastics and having at least one stop formation arranged to restrain movement along the pipe of a structure attached to the pipe. The features of the stop formation associated with the pipe may therefore be associated with the stop bracket, for example a downwardly-facing shoulder to resist upthrust acting on a structure when that structure is attached to the pipe via the bracket. Similarly, an upwardly-facing shoulder may be provided to resist weight load acting on such a structure, as can a key formation to resist rotation of such a structure about the pipe.

The inventive concept also extends to a pipe of the invention when supporting a structure attached to the pipe or to the bracket. The structure may be: a guide frame for a hybrid riser tower arranged to guide at least one other pipe of the tower; a buoyancy module for a hybrid riser tower; or a guide frame transmitting upthrust to the pipe from at least one buoyancy module. In this respect, it is preferred that the structure is attached to the coated pipe, whether directly or via the bracket, by a primary attachment provision such as clamping. This leaves the stop formation as a secondary, auxiliary or fall-back provision for attachment or location.

Finally, of course, the inventive concept also embraces a hybrid riser tower comprising a pipe of the invention or a stop bracket of the invention. A hybrid riser tower will generally include structures such as guide frames and buoyancy modules attached to or acting on the pipe, whether directly or via the bracket.

In order that the invention may be more readily understood, reference will now be made, by way of example, to the accompanying drawings in which.

Figure 4:
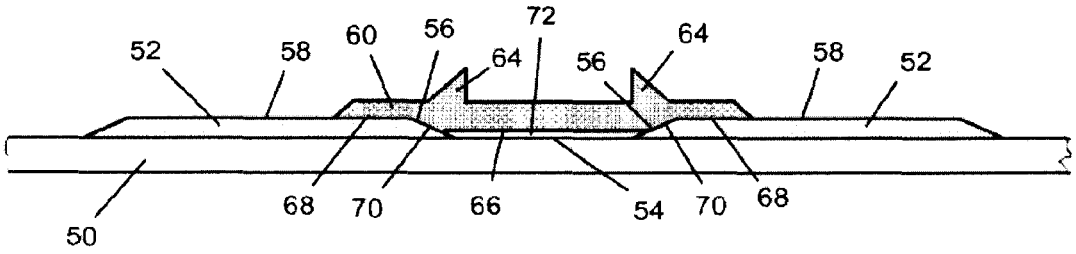
FIG. 4 is a schematic detail view of a wall of a flowline pipe in longitudinal section in a plane containing the central longitudinal axis of the pipe, showing an injection-moulded PU insert defining circumferentially-extending stop collars fixed over a field joint region where a 3LPP coating of the pipe has been machined away.
Figure 5:
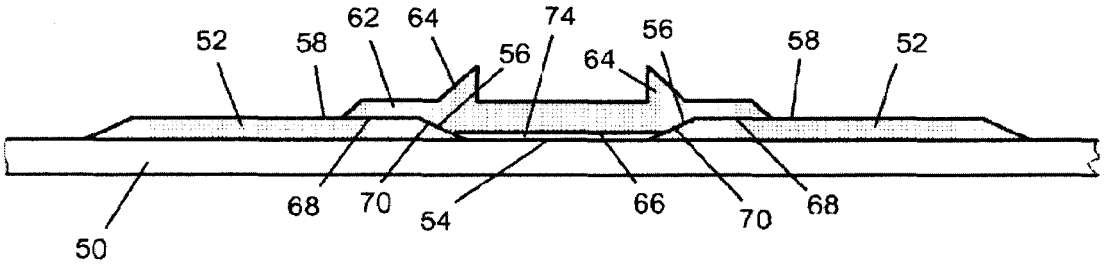
Figure 6:
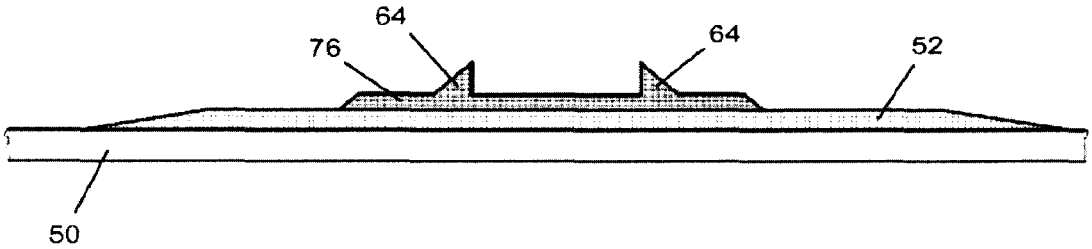
Figure 7:
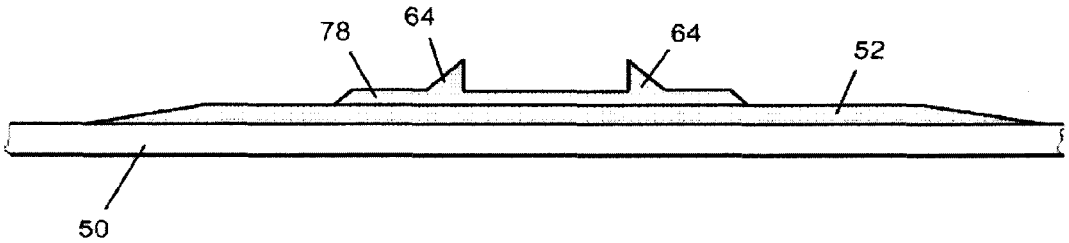
Figure 8A:
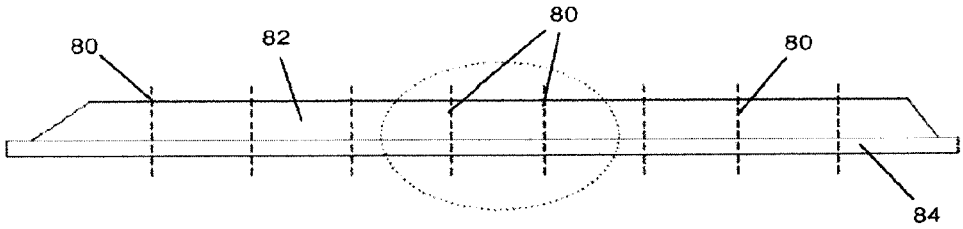
Figure 8B:
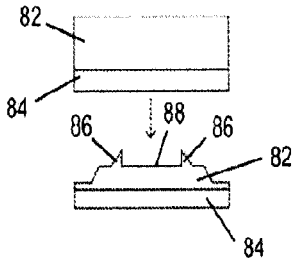

FIG. 5 corresponds to FIG. 4 but shows the insert moulded of PP instead of PU;

FIG. 6 is a schematic detail view of a wall of a flowline pipe in longitudinal section in a plane containing the central longitudinal axis of the pipe, showing an injection-moulded PU insert defining circumferentially-extending stop collars fixed to a continuous 3LPP coating of the pipe;

FIG. 7 corresponds to FIG. 4 but shows the insert moulded of PP instead of PU;

FIG. 8*a* is a schematic view of a wall of a flowline pipe in longitudinal section in a plane containing the central longitudinal axis of the pipe, the pipe in this case being coated with a 5LPP coating that is cut away and machined to define circumferentially-extending stop collars;

FIG. 8*b* is a detail view of a portion of the flowline pipe shown in FIG. 8*a;*

Figure 9:
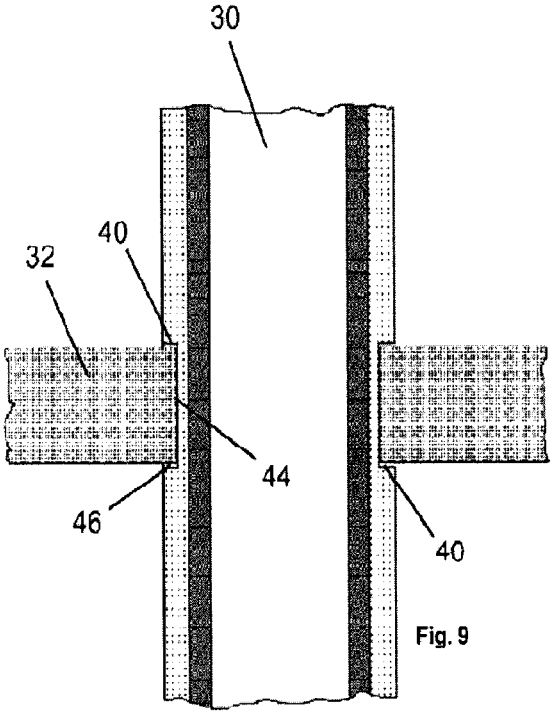
Figure 10:
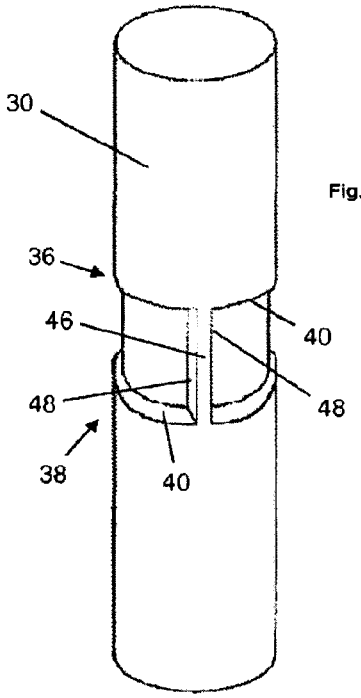

FIG. 9 is a schematic side view of a coated flowline pipe adapted in accordance with the invention, in longitudinal section in a plane containing a key formation in the pipe coating, showing a guide frame located axially by circumferentially-extending shoulders defined within the coating thickness of the pipe; and FIG. 10 is a schematic perspective view of the coated flowline pipe seen in FIG. 9, showing the parallel, spaced shoulders extending circumferentially around the pipe and joined by the axially-extending key formation.

Figure 1:
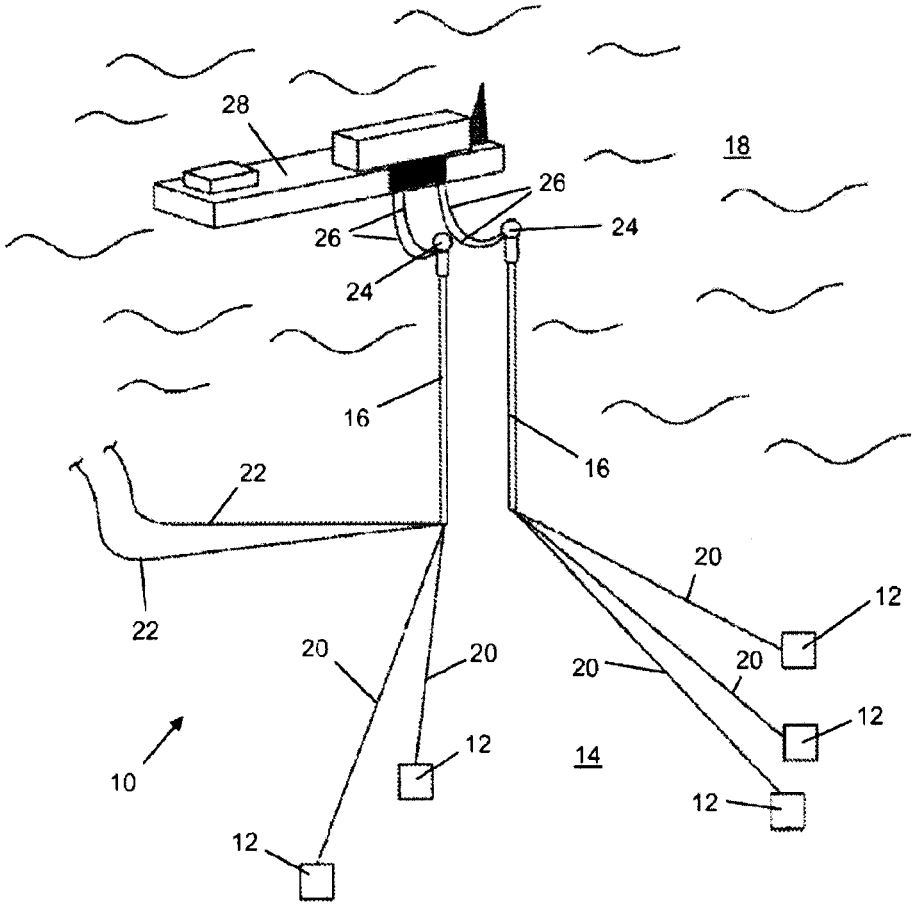
FIG. 1 is a much-simplified schematic perspective view of a subsea oil-production installation including HRTs, to put the invention into context.

Referring firstly to FIG. 1, this shows a subsea oil-production installation 10 comprising well heads, injection sites, manifolds and other pipeline equipment generally designated 12 located on the seabed 14 in an oil field. This drawing is not to scale: in particular, the water depth will be very much greater in practice than is suggested here.

Upright HRTs 16 convey production fluids from the seabed 14 to the surface 18 and convey lifting gas, injection water and treatment chemicals such as methanol from the surface 18 to the seabed 14. For this purpose. the base of each HRT 16 is connected to various well heads and injection sites 12 by horizontal pipelines 20. Further pipelines 22 optionally connect to other well sites elsewhere on the seabed 14.

The HRTs 16 are pre-fabricated at shore facilities, towed to their operating location and then installed on the seabed 14 with anchors at the bottom and buoyancy at the top provided by a buoyancy tank 24. Optionally, additional buoyancy is provided by buoyancy modules distributed along the riser column of each HRT 16.

Each HRT 16 comprises a bundle of pipes defining separate but parallel conduits for the various fluids that those pipes carry individually. Guide frames are distributed along the riser column in a manner similar to that of WO 2010/035248.

Buoyancy modules, where used, may apply upthrust directly to the riser column or indirectly via the guide frames.

The guide frames may also be used to guide or support umbilicals, optical fibres, cables and the like included in the HRT 16.

Flexible flowlines 26 extend in a catenary configuration from the riser column of each HRT 16 to a floating production, storage and offloading (FPSO) vessel 28 moored nearby at the surface 18. The FPSO vessel 28 provides production facilities and storage for the fluids coming from and going to the seabed equipment 12.

Figure 2:
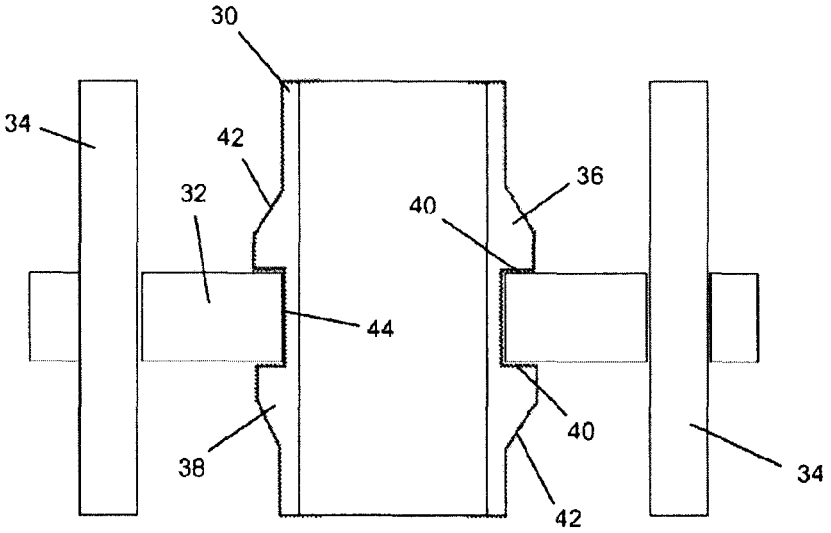
FIG. 2 is a schematic sectional side view showing a guide frame located axially by circumferentially-extending stop collars on a coated flowline pipe, to illustrate the principle of the invention.

Referring now to FIG. 2, this illustrates the principle of the invention by showing a coated flowline pipe 30 supporting a guide frame 32 that extends generally in a plane orthogonal to a central longitudinal axis of the pipe 30. As the pipe 30 carries hot fluids in use, this is immediately distinguished from WO 2010/035248 in which a guide frame is instead supported by a structural core tube that does not carry fluids.

The pipe 30 is the core pipe in the riser column of an HRT 16 as shown in FIG. 1. Other parallel pipes 34 in the bundle extend through the guide frame 32. Two such pipes 34 are shown but as explained above, there will in practice be several more pipes and also other elongate elements such as umbilicals or cables in the bundle.

The guide frame 32 holds the bundled pipes 30, 34 relative to each other against horizontal movement in the two lateral dimensions (X- and Y-axis movement). However the guide frame 32 does not constrain relative longitudinal (Z-axis) movement between the bundled pipes 30, 34 to allow for differential elongation and contraction of the pipes 30, 34 under pressure and temperature fluctuations in use. For this purpose, the guide frame 32 is fixed axially to the pipe 30 but is not fixed axially to the pipes 34, which are therefore free to slide axially through the guide frame 32 as may be dictated by differential expansion between the pipes 30, 34.

As the pipe 30 is a flowline that carries hot fluids in use, a conventional stopper solution is not possible in the arrangement shown in FIG. 2. Instead, in accordance with the invention, radially-extending upper 36 and lower 38 stop formations of plastics are integral with or attached to the coating of the pipe 30.

In this example, the stop formations 36, 38 are ridges or collars that extend circumferentially and continuously around the flowline pipe 30. Each stop formation 36, 38 comprises a shoulder 40 that lies in a plane orthogonal to a central longitudinal axis of the pipe 30, and a frusto-conical face 42 that faces generally away from the shoulder 40 and tapers down to the surrounding outer diameter of the pipe 30.

The stop formations 36, 38 are spaced axially from each other along the flowline pipe 30 as a mutually-opposed pair. Their shoulders 40 are in facing relation, sandwiching the guide frame 32. The cross-sectional shapes of the stop formations 36, 38 are preferably mirrored about the central plane of the guide frame 32 as shown.

Thus, the shoulders 40 of the stop formations 36, 38 define between them a circumferential groove 44 that extends around the pipe 30. The groove 44 provides axial location for the guide frame 32 in opposite axial directions, namely up and down when the pipe 30 is oriented for use in a riser column of an HRT 16 as shown in FIG. 1.

The upper stop formation 36 is positioned to resist upward movement of the guide frame 32 along the supporting pipe 30 under the buoyant load of buoyancy modules. Conversely, the lower stop formation 38 is positioned to resist downward movement of the guide frame 32 along the supporting pipe 30 under the weight load of the guide frame 32, which is generally of negative buoyancy and so has weight in sea water.

Whilst the stop formations 36, 38 could, in principle, together fix the guide frame 32 axially with respect to the pipe 30, it is preferred that clamping is the primary means of attachment between the guide frame 32 and the pipe 30. For example, as in WO 2010/035248, the guide frame 12 may be in two or more parts that are assembled around the pipe 30 to apply radially inward clamping force against the pipe 30 at the base of the groove 44.

Where the guide frame 32 clamps to the pipe 30, the stop formations 36, 38 are a back-up provision in case the clamping force slackens and the guide frame could otherwise slip along the pipe 30 as a result. Nevertheless it is preferred that the guide frame 32 is a snug fit in the groove 44 to preserve insulation. Insulation is also aided by the guide frame 32 being of plastics material, as is preferred.

Figure 3:
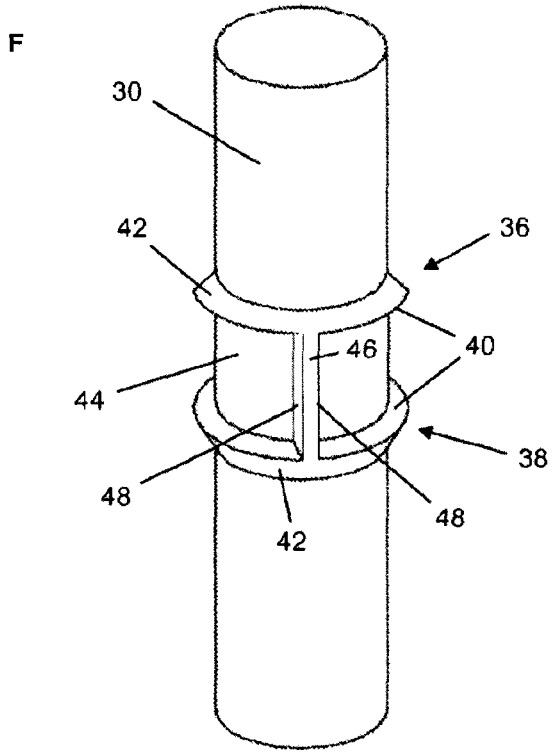
FIG. 3 is a schematic perspective view of a coated flowline pipe adapted in accordance with the invention, showing parallel, spaced stop collars extending circumferentially around the pipe and joined by an axially-extending key formation.

Moving on to FIG. 3, this shows a coated flowline pipe 30 with the guide frame 32 removed. The arrangement is broadly similar to that of FIG. 2 and like numerals are used for like parts. Again, upper and lower stop formations 36, 38 of plastics extend radially and circumferentially around the pipe 30 and are integral with or attached to the coating of the pipe 30. Also as in FIG. 2, each stop formation 36, 38 comprises a shoulder 40 that lies in a plane orthogonal to a central longitudinal axis of the pipe 30, and a frusto-conical face 42 that faces generally away from the shoulder 40 and tapers down to the surrounding outer diameter of the pipe 30. The stop formations 36, 38 are mutually parallel and are spaced apart to define a circumferential groove 44 between them that receives a guide frame 32 like that of FIG. 2.

FIG. 3 shows the optional addition of a key formation 46 disposed between the stop formations 36, 38. The key formation 46 has side walls 48 that engage complementary formations of the guide frame 32 to resist torsional or rotational movement of the guide frame 32 circumferentially about the pipe 30. Torsional movement of the guide frames 32 about the pipe 30 is a particular risk when an HRT 16 is being towed to its operating location.

In this example, the key formation 46 extends axially between the stop formations 36, 38. Specifically, the key formation 46 is a ridge that joins the stop formations 36, 38 and is of similar depth, or radial extent, to the shoulders 40 of the stop formations 36, 38. The key formation 46 locates in a complementary slot in the guide frame 32 to resist torsional movement of the guide frame 32 with respect to the pipe 30.

FIGS. 4 to 7 show a wall of a flowline pipe 50 coated with a 3LPP coating 52 and fitted with various injection-moulded plastics stop brackets attached to the pipe 50 by bonding and/or welding. In these examples, the cost of a specific mould must therefore be taken into account. Where appropriate, like numerals are used for like parts in FIGS. 4 to 7. Reference will be made firstly to FIGS. 4 and 5 and next to FIGS. 6 and 7.

In FIGS. 4 and 5, the coating 52 has been machined away from the pipe 50 circumferentially to expose the pipe 52 at a field joint region 54. This separates the coating 52 into two axially-spaced portions, facing end surfaces 56 of which taper inwardly and frusto-conically from an outer diameter 58 of the coating 52 toward the exposed surface of the pipe 50.

In each case, a stop bracket 60, 62 is bonded or welded to the opposed coating portions 52 to span the field joint region 54 and to enclose the exposed surface of the pipe 50. A stop bracket 60, 62 encircles the pipe 50 and is suitably assembled from segments around the pipe 50. FIG. 4 shows a stop bracket 60 of PU whereas FIG. 5 shows a stop bracket 62 of PP.

Each stop bracket 60, 62 has a stepped, tubular inner profile shaped to complement the shape of the field joint region 54 and an outer profile shaped to define stop formations 64 to locate a guide frame. Each stop bracket 60, 62 is symmetrical about its centreline between its ends.

On its inner side, each stop bracket 60, 62 has a central narrow tubular section 66 that lies between the coating portions 52 and wider end sections 68 that lie on the outer diameters 58 of the respective coating portions 52. Outwardly-inclined, frusto-conical steps 70 at opposite ends of the central section 66 join the central section 66 to the end sections 68. The inclination of the steps 70 complements the inclination of the facing end surfaces 56 of the coating portions 52.

The outer side of each stop bracket 60, 62 is cylindrical and of uniform diameter apart from inwardly tapered ends and the integral stop formations 64 of plastics extending radially and circumferentially around the stop bracket 60, 62.

A stop bracket 60, 62 is bonded or welded to the 3LPP coating 52 at the steps 70 and end sections 68 of its internal profile. The central section 66 of the stop bracket 60 is bonded to the exposed surface of the pipe 50 at the field joint region 54.

For the PU stop bracket 60 of FIG. 4, a PU primer 72 is applied to the exposed surface of the pipe 50 at the field joint region 54 to enable the central section 66 of the PU stop bracket 60 to be bonded to that exposed surface of the pipe 50. The PU primer 72 also provides corrosion protection.

For the PP stop bracket 62 of FIG. 5, the exposed surface of the pipe 50 at the field joint region 54 is coated with a fusion-bonded epoxy coating 74 to which the central section 66 of the PP stop bracket 62 is bonded.

In FIGS. 6 and 7, the coating 52 is not machined and instead extends continuously along the pipe 50 under tubular stop brackets 76, 78 bonded or welded to the coating 52. The lack of machining advantageously avoids a process step. FIG. 6 shows a stop bracket 76 of PU whereas FIG. 7 shows a stop bracket 78 of PP.

The outer side of each stop bracket 76, 78 is identical to the stop brackets 60, 62 of FIGS. 4 and 5, with integral stop formations 64 of plastics extending radially and circumferentially around the stop bracket 76, 78. Unlike the stop brackets 60, 62 of FIGS. 4 and 5, the inner side of each stop bracket 76, 78 is of uniform diameter along its length.

Again, the stop brackets 76, 78 are suitably assembled from segments to encircle the pipe 50 but it would be possible in this instance for a stop bracket 76, 78 to extend only part of the way around the circumference of the pipe 50 if desired.

Various factors may influence the choice of material for the stop brackets 60, 62, 76, 78 shown in FIGS. 4 to 7. PU is cheaper than PP, its fatigue behaviour is well understood, and good adhesion can be achieved between the central section 66 of the PU stop bracket 60 and the exposed outer surface of the pipe 50. However, the dissimilarity between a PU stop bracket 60, 76 and the PP coating 52 reduces the bond strength between them: a PP to PP bond is preferred. A PP stop bracket 62, 78 also enjoys good adhesion to the exposed outer surface of the pipe 50.

Further issues that may influence the choice of material for the stop brackets 60, 62, 76, 78 in favour of PP are: PU is at risk of degradation due to hydrolysis under heat emanating from within the flowline pipe 50 in use, which is a particular challenge under the high-pressure conditions of deep water. Besides, mercury can no longer be used in PU catalysts for environmental reasons, which may adversely affect the properties of the material.

Turning now to FIGS. 8*a* and 8*b* of the drawings, an alternative approach embraced by the broad inventive concept is illustrated. This approach is used where a flowline pipe has a thicker 5LPP coating; it exploits the thickness of that coating to allow stop formations to be machined or milled from the coating itself.

FIG. 8*a* shows, schematically, how radial cuts 80 may be made at intervals through the 5LPP coating 82 in planes orthogonal to a central longitudinal axis of a flowline pipe 84. Between two such cuts 80, the coating 82 is machined or milled away to form a recess with a base profile defining axially-spaced, radially-extending circumferential stop formations 86 as illustrated in FIG. 8*b*. FIG. 8*b* illustrates a circumferential groove 88 between the stop formations 86 is arranged to receive an inner edge of a guide frame. Again, the primary means of attachment for the guide frame on the pipe 84 is clamping, with radially inward force being exerted by the guide frame on the base of the groove 88.

Although not shown in FIGS. 4 to 8*a* and 8*b*, one or more key formations may be provided between the stop formations to resist rotational movement of the guide frame around the flowline pipe to which it is attached. For example, FIGS. 9 and 10 show how stop formations and optionally also a key formation may be machined or milled by removing material from the thickness of the pipe or the coating, so that the stop formations and the key formation are defined wholly or partially within the surrounding outer diameter of the pipe. As FIGS. 9 and 10 correspond to FIGS. 2 and 3, like numerals are used for like parts in the description that follows.

FIG. 9 shows a coated flowline pipe 30 supporting a guide frame 32 that extends generally in a plane orthogonal to a central longitudinal axis of the pipe 30 in the riser column of an HRT 16. Other parallel pipes, umbilicals and cables are omitted from this view.

In this variant of the invention, radially-extending (but not radially protruding) upper 36 and lower 38 stop formations of plastics are integral with the coating of the pipe 30, in this example comprising circumferentially-extending shoulders 40 within the outer diameter of the coated pipe. The shoulders 40 lie in parallel planes orthogonal to a central longitudinal axis of the pipe 30 and are spaced axially from each other along the pipe 30 as a mutually-opposed pair to sandwich an inner edge of the guide frame 32. Thus, the shoulders 40 define between them a circumferential groove 44 that extends around the pipe 30. The groove 44 provides axial location for the guide frame 32 in opposite axial directions, namely up and down when the pipe 30 is oriented for use in a riser column of an HRT 16 as shown in FIG. 1.

Again, it is preferred that clamping is the primary means of attachment between the guide frame 32 and the pipe 30, with the shoulders 40 being a back-up provision in case the clamping force slackens and the guide frame could otherwise slip along the pipe 30.

FIGS. 9 and 10 also show the optional addition of a key formation 46 disposed between the shoulders 40. The key formation 46 fits in a complementary slot or notch in an opening of the guide frame 32 that receives the pipe 30, and has side walls 48 that engage that complementary formation of the guide frame 32 to resist rotation of the guide frame 32 about the pipe 30. Again, the key formation 46 extends axially between the stop formations 36, 38, being more specifically a ridge that joins the shoulders 40 and is of similar depth to them.

The plastics material around the stop formations and key formations may be reinforced by, for example, metallic, composite or fibre inserts. Reinforcement such as straps, clamps or mechanical engagement may also be provided to support the stop brackets on the flowline pipe, as a back-up to bonded or welded attachment.

Many other variations are possible within the inventive concept. For example, it would be possible to omit the lower stop formation, leaving the upper stop formation to resist upward movement of the guide frame along the supporting flowline pipe under the buoyant load of buoyancy modules. It would also be possible to omit the key formation.

The stop formations need not extend all of the way around the flowline pipe: they could be discontinuous or be discrete formations distributed around the circumference of the supporting flowline pipe. For example, as noted above, a stop bracket defining stop formations may extend only part-way around a pipe. However, continuous circumferential stop formations are preferred as they maximise strength and are apt to be formed by machining.

Instead of steel, the core pipe could be made of a thermoset or thermoplastic composite material such as a carbon fibre-reinforced epoxy or a carbon fibre-reinforced PA (polyamide) or PEEK (polyetheretherketone). The plastics coating of the pipe described above could be replaced by an epoxy sleeve cast in situ.

The invention claimed is:

1. An externally coated or sleeved pipe suitable for supporting guide frames or other structures in a hybrid riser tower, the pipe having a pair of stop formations defining between them a circumferential channel that extends around the pipe, the stop formations being arranged to restrain movement along the pipe of a structure engaged within the circumferential channel attached to the pipe, which formations are part of the external coating or sleeve of the pipe or are part of a stop bracket, predominantly of plastics, that is welded or bonded to the external coating or sleeve.

2. The pipe of claim 1, wherein the pipe is a flowline for carrying fluids up or down the tower.

3. The pipe of claim 1, wherein the pair of stop formations are insulated from the pipe by the external coating or sleeve of the pipe.

4. The pipe of claim 1, wherein one of the stop formations of the pair of stop formations comprises a downwardly-facing shoulder to resist upthrust acting on a structure when attached to the pipe.

5. The pipe of claim 1, wherein one of the stop formations of the pair of stop formations comprises an upwardly-facing shoulder to resist weight load acting on a structure when attached to the pipe.

6. The pipe of claim 1, wherein each stop formation of the pair of stop formations extends radially outwardly beyond a general outer diameter of the pipe.

7. The pipe of claim 1, wherein each stop formation of the pair of stop formations is predominantly of plastics.

8. The pipe of claim 1, wherein the pair of stop formations are part of a stop bracket welded or bonded to the external coating or sleeve of the pipe and also to an exposed wall of the pipe.

9. The pipe of claim 1, wherein the pair of stop formations are part of a stop bracket welded or bonded to the external coating or sleeve of the pipe and the welding or bonding is supplemented by a mechanical connection between the stop bracket and the coated or sleeved pipe.

10. The pipe of claim 1, wherein the pair of stop formations are part of a stop bracket welded or bonded to a continuous interface area of the external coating or sleeve of the pipe.

11. The pipe of claim 1, wherein the external coating or sleeve of the pipe is interrupted by an exposed wall of the pipe and the pair of stop formations are part of a stop bracket that spans the interruption, being welded or bonded to external coating or sleeve portions opposed across the interruption.

12. The pipe of claim 11, wherein the opposed coating or sleeve portions comprise facing end surfaces and the stop bracket lies at least partially between those facing end surfaces.

13. The pipe of claim 12, wherein a portion of the stop bracket lying between the facing end surfaces is bonded to the exposed wall of the pipe.

14. The pipe of claim 1, wherein the pair of stop formations are machined from the external coating or sleeve of the pipe.

15. In combination, the pipe as defined in claim 1 with a structure attached to the pipe or to the bracket, the structure being: a guide frame for a hybrid riser tower arranged to guide at least one other pipe of the tower; a buoyancy module for a hybrid riser tower; or a guide frame transmitting upthrust to the pipe from at least one buoyancy module.

16. The combination of claim 15, wherein the structure is attached to the pipe or to the bracket by a primary attachment provision such as clamping and the pair of stop formations are a secondary, auxiliary or fall-back provision for attachment or location.

17. A stop bracket attachable by welding or bonding to an external coating or sleeve of a pipe for a hybrid riser tower, the bracket being predominantly of plastics and having a pair of stop formations for defining between them a circumferential channel around the pipe, the stop formations being arranged to restrain movement along the pipe of a structure engaged within the circumferential channel attached to the pipe.

18. The stop bracket of claim 17, wherein one of the stop formations of the pair of stop formations comprises a downwardly-facing shoulder to resist upthrust acting on a structure when attached to the pipe via the bracket.

19. The stop bracket of claim 17, wherein one of the stop formations of the pair of stop formations comprises an upwardly-facing shoulder to resist weight load acting on a structure when attached to the pipe via the bracket.

20. The stop bracket of claim 17 further comprising a stepped interface surface arranged to lie against the pipe and its coating or sleeve, the interface surface comprising end sections separated by a central section that is stepped toward the pipe.

21. The stop bracket of claim 20, wherein step surfaces between the central section and the end sections are frustoconically inclined.

22. The stop bracket of claim 17 further comprising a continuous interface surface arranged to lie against the coating or sleeve of the pipe, a longitudinal section through the interface surface being substantially straight.

23. A hybrid riser tower comprising:

at least one externally coated or sleeved pipe suitable for supporting guide frames or other structures in a hybrid riser tower, the pipe comprising a pair of stop formations defining between them a circumferential channel around the pipe, the stop formations being arranged to restrain movement along the pipe of a structure engaged within the circumferential channel attached to the pipe, which formations are part of the external coating or sleeve of the pipe or are part of a stop bracket, predominantly of plastics, that is welded or bonded to the external coating or sleeve.

* * * * *